US008011411B2

(12) United States Patent
Eitel et al.

(10) Patent No.: US 8,011,411 B2
(45) Date of Patent: Sep. 6, 2011

(54) PAD FOR EMBOSSING DEVICE

(75) Inventors: Hans-Georg Eitel, Bad-Homburg (DE); Rainer Gebhardt, Offenbach (DE); Wolfgang Mexner, Rüsselsheim (DE); Uwe Püschel, Heidesheim (DE); Michael Reising, Offenbach (DE); Guido Reschke, Hünfelden-Ohren (DE); Jürgen Schölzig, Mainz (DE); Michael Zinke, Limburg (DE)

(73) Assignee: manroland AG, Offenbach (DE)

( * ) Notice: Subject to any disclaimer, the term of this patent is extended or adjusted under 35 U.S.C. 154(b) by 854 days.

(21) Appl. No.: 11/578,310

(22) PCT Filed: Apr. 13, 2005

(86) PCT No.: PCT/EP2005/003878

§ 371 (c)(1),
(2), (4) Date: Jan. 3, 2007

(87) PCT Pub. No.: WO2005/100025

PCT Pub. Date: Oct. 27, 2005

(65) Prior Publication Data

US 2007/0163455 A1 Jul. 19, 2007

(30) Foreign Application Priority Data

Apr. 13, 2004 (DE) ..... 10 2004 018 306
Apr. 29, 2004 (DE) ..... 10 2004 021 102
Feb. 4, 2005 (DE) ..... 10 2005 005 491

(51) Int. Cl.
*B44F 5/00* (2006.01)

(52) U.S. Cl. ..... 156/582; 156/230

(58) Field of Classification Search ..... 156/582, 156/230, 580
See application file for complete search history.

(56) References Cited

U.S. PATENT DOCUMENTS 2,804,417 A * 8/1957 Cross et al. ..... 442/148
3,126,826 A * 3/1964 Fischer ..... 101/420
3,858,977 A 1/1975 Baird et al.
4,465,538 A 8/1984 Schmoock
5,207,855 A 5/1993 Nyfeler et al.
(Continued)

FOREIGN PATENT DOCUMENTS

DE 831845 1/1952
(Continued)

OTHER PUBLICATIONS

"Prindor: Neue Technologie der Folienprägung—heriss oder kalt?", Deutscher Drucker, Deutscher Drucker Verlagsgesellschaft, Ostfildern, DE, Bd. 32, Nr. 14/15, Apr. 18, 1996, Seite G15, XP000584416 ISSN: 0012-1096 das ganze Dokument.

(Continued)

*Primary Examiner* — Katarzyna I. Wyrozebsky
*Assistant Examiner* — Margaret Squalls
(74) *Attorney, Agent, or Firm* — Leydig, Voit & Mayer, Ltd.

(57) ABSTRACT

For transferring an image-forming layer from a transfer foil a printing sheet, an adhesive layer is first applied to the sheet to be printed. The transfer foil provided with the image-forming layer is guided past the printing sheet under pressure, in a coating module (2), such that the image-forming layer adheres to the adhesive and an image is created. The present invention provides a foil transfer device that includes a substrate on the press cylinder that has a reduced adhesiveness relative to the transfer foil.

12 Claims, 2 Drawing Sheets

U.S. PATENT DOCUMENTS

| | | | | |
|---|---|---|---|---|
| 5,250,758 | A | 10/1993 | Fjelstad et al. | |
| 5,565,054 | A * | 10/1996 | Lappe et al. | 156/234 |
| 5,603,259 | A | 2/1997 | Gross et al. | |
| 5,618,378 | A | 4/1997 | Cahill | |
| 5,775,225 | A | 7/1998 | Saitou | |
| 5,891,289 | A | 4/1999 | Zemel | |
| 6,203,914 | B1 * | 3/2001 | Sudo et al. | 428/423.3 |
| 6,395,120 | B1 | 5/2002 | Bradbury-Harris et al. | |
| 6,779,442 | B2 | 8/2004 | Strasser | |
| 6,811,863 | B2 | 11/2004 | Rizika et al. | |
| 6,909,444 | B2 | 6/2005 | Ishida et al. | |
| 2003/0015111 | A1 * | 1/2003 | Rizika et al. | 101/416.1 |
| 2003/0140803 | A1 * | 7/2003 | Bitterich et al. | 101/148 |

FOREIGN PATENT DOCUMENTS

| | | | |
|---|---|---|---|
| EP | 0148601 | A2 | 7/1985 |
| EP | 0195857 | A2 | 10/1986 |
| EP | 0414362 | A2 | 2/1991 |
| EP | 0441596 | A1 | 8/1991 |
| EP | 0569520 | | 11/1993 |
| EP | 0945280 | A2 | 9/1999 |
| EP | 1147893 | A2 | 10/2001 |
| GB | 1574908 | | 9/1980 |
| JP | 2004101834 | A1 | 4/2004 |
| WO | WO 9212859 | A1 | 8/1992 |
| WO | WO 9413749 | A1 | 6/1994 |
| WO | WO 0234521 | A1 | 5/2002 |
| WO | WO 2004041546 | A1 | 5/2004 |
| WO | WO 2005021276 | A1 | 3/2005 |

OTHER PUBLICATIONS

Walther T: "Offsetdruck und Folientransfer in nur einem Durchgang" Deutscher Drucker, Deutscher Drucker Verlagsgesellschaft, Ostfildern, DE, vol. 40, No. 15, Apr. 29, 2004, p. 42, 44, XP001196256 ISSN: 0012-1096, p. 42, col. 3, line 1-line 6.

Emeriau L: "La dorure est <<Vernie >> Grace Au Dispositif Speedor D'Ecamo, La Dorure A Froid Sur Presse Offset" Caractere, CEP Information Professions. Paris, FR, vol. 45, No. 387/388, Oct. 4, 1994, pp. 146-147, XP000476375 ISSN: 0247-039X, p. 147, col. 1, line 12-line 25.

* cited by examiner

Fig. 2
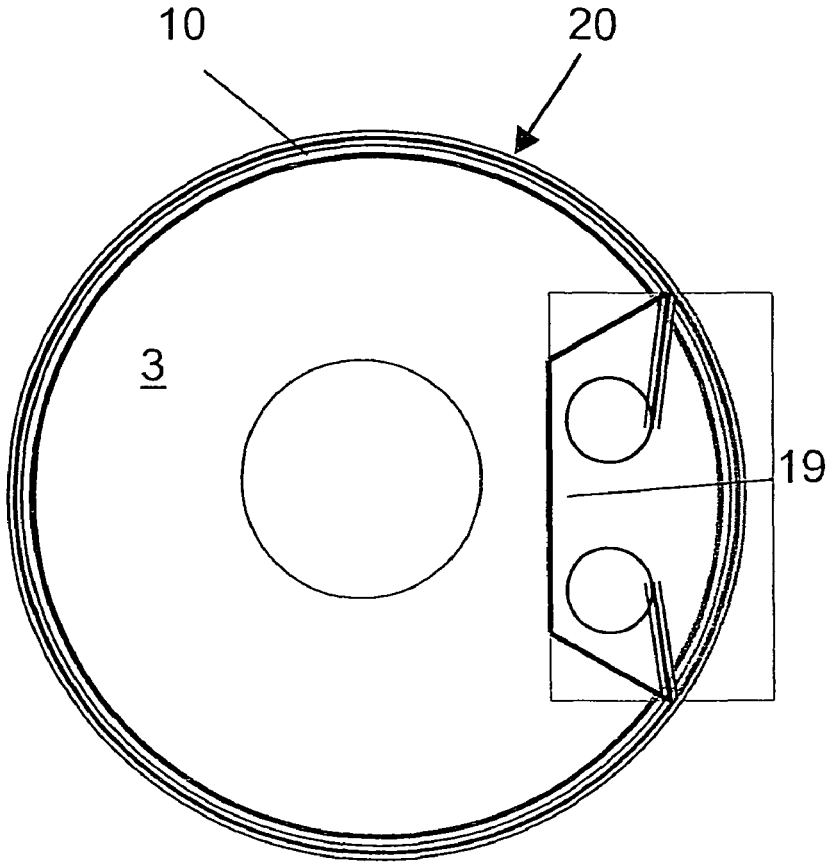
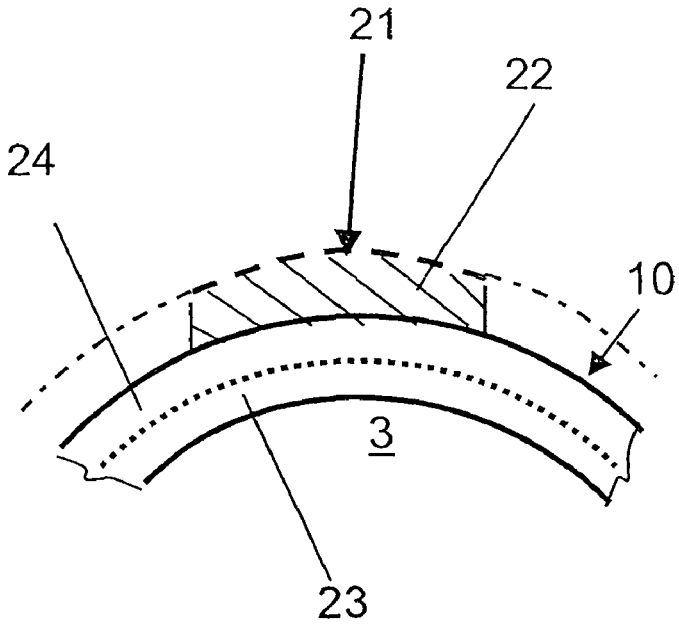
Fig. 3

PAD FOR EMBOSSING DEVICE

FIELD OF THE INVENTION

The invention pertains to a device for transferring image forming layers from a carrier or transfer foil to printing sheets.

BACKGROUND OF THE INVENTION

Producing metallic layers on printing sheets using a foil transfer method is known. For example, a printing material and a printing device that uses this material is described in EP 0 569 520 B1. In that reference, a sheet processing machine is disclosed that includes a sheet feeder and a sheet delivery unit. Printing units and a coating module are located between the sheet feeder and delivery units. In at least one of the printing units, an adhesive pattern is applied using a flat printing process. This adhesive pattern is applied using a cold printing process and has a particular image-forming design. A foil guide is located in the coating module following the printing unit which includes an impression cylinder and press cylinder. The foil guide is designed such that a foil strip or transfer foil is moved from a foil supply roll through a transfer gap in the coating module between the impression cylinder and the press cylinder. The foil strip is rewound on the outlet or delivery side after leaving the coating module. The transfer foil includes a carrier layer on which image-forming layers, such as metallic (e.g., aluminum) layers, can be applied. A separating layer is arranged between the metallic layer and the carrier foil to ensure that the metallic layer can be removed from the carrier layer.

When printing sheets are transported through the printing unit, each printing sheet is provided with an adhesive pattern. The printing sheet is then guided through the coating module, wherein the printing sheet resting upon the impression cylinder is brought into contact with the foil material via the press cylinder. In this case, the metallic layer that is positioned on the bottom makes a tight bond with the areas of the printing sheet provided with the adhesive. As the printing sheet continues to move forward, the metallic layer adheres only in the area of the adhesive pattern. As a result, the metallic layer is removed from the carrier foil in the area of the adhesive pattern. The consumed transfer foil is then rewound. The printing sheet is delivered in the coated state.

It is known to use of coating modules of this type in printing units of printing machines. However, a disadvantage of these modules is that they cannot be employed in a flexible manner. Moreover, such modules consume a considerable amount of transfer foil.

BRIEF SUMMARY OF THE INVENTION

In view of the foregoing, an object of the present invention is to provide an apparatus that enables the transfer of an image-forming layer to a printing sheet to take place in a reliable, economical and precise manner. As a result, the apparatus is also easy to use.

A cycling method is preferably used to control the transfer foil with the transfer foil being separated from the press cylinder by a pneumatic mechanism during the timing step. Moreover, to ensure economic efficiency of the coating method, the foil advance can be controlled such that the transfer foil is stopped when no imaging or metallic layer is to be transferred.

Advantageously, the transfer foil can be controlled such the foil advance is stopped when passing a gripper channel on the sheet guiding impression cylinder with the press cylinder sliding along under the transfer foil.

In a further embodiment, the surface of the press cylinder can include an elevated press surface with a contoured perimeter that is limited to the region being coated. With such an arrangement, a specifically configured blanket, a plastic printing form or a glue-on contact segment can be used as the press surface. As a result, the advance of the transfer foil can be stopped even when the area to be coated is located inside the image area of the printing sheet. The utilization of the transfer foil can be further improved by using a transfer foil that is divided into one or more partial foil webs of smaller width. With such a divided transfer foil, different types of foil can be employed side by side.

BRIEF DESCRIPTION OF THE SEVERAL VIEWS OF THE DRAWINGS

FIG. 2 is a schematic side view of the press cylinder of the foil transfer device of FIG. 1.

FIG. 3 is a schematic side view of part of the press cylinder of FIG. 2 showing the press covering.

DETAILED DESCRIPTION OF THE INVENTION

Figure 1:
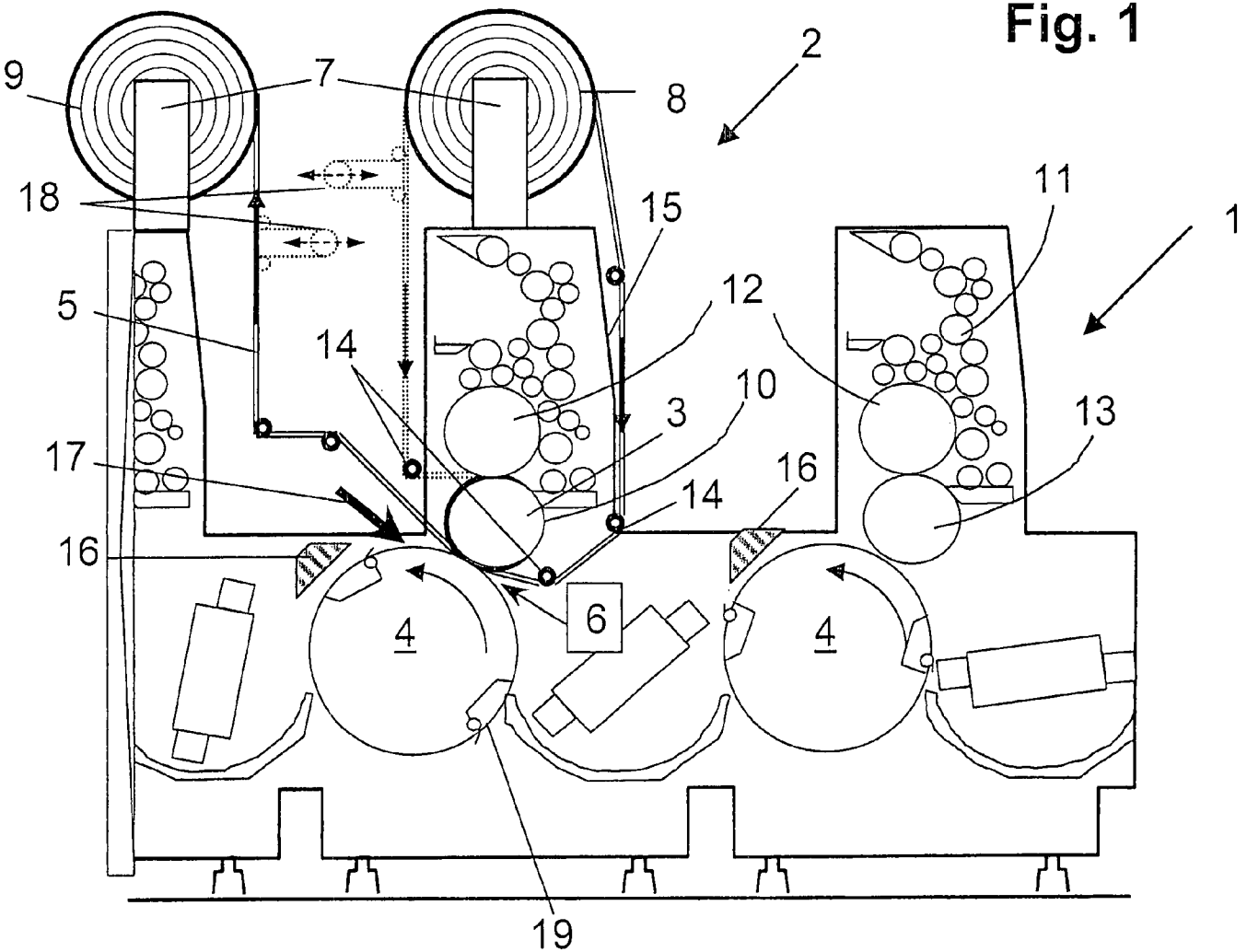
FIG. 1 is a schematic side view of an illustrative printing machine having a foil transfer device according to the invention.

Referring to FIG. 1 of the drawings, a sheet processing machine, in this case a printing press, that includes at least two printing units is shown. The two printing units can be used as described below to transfer an image-forming layer from a transfer foil to a printing sheet.

In a first step, a printing sheet to be coated is provided with an image-forming adhesive pattern. The application of the adhesive takes place in an application unit 1. The application unit 1 can comprise, for example, a conventional printing unit of an offset printing press. In such a printing unit, the adhesive is applied using inking and dampening units 11, a printing plate on a plate cylinder 12, a blanket or rubber cylinder 13 and an impression cylinder 4. Similarly, application units in the form of flexographic printing units or varnishing or lacquering units can be used.

In a second step, a transfer foil 5 together with a printing sheet is passed through a transfer gap 6. In the transfer gap, the transfer foil 5 is pressed against the printing sheet. In this case, a coating module 2 is used which can correspond to a printing unit, a lacquering or varnishing module, a base unit or any other kind of processing unit or module of a sheet-fed offset printing press. The transfer gap 6 in the coating module 2 is defined by a press cylinder 3 and an impression cylinder 4. The press cylinder 3 can correspond to a blanket or form cylinder and the impression cylinder 4 can correspond to an impression cylinder of a known offset printing unit. In addition, the press cylinder 3 can correspond to a form cylinder and the impression cylinder 4 can correspond to a impression cylinder of a varnishing module of a sheet-fed printing press. A so-called calendaring unit can be arranged downstream of the coating module 2 if the coated printing sheet is to be rolled under elevated pressure in order to increase the adhesion of the coating or increase the smoothness and gloss of the printing sheet.

A sheet guide for the transfer foil 5 can be provided within the coating module 2. The transfer foils 5 that are used can have a multi-layer structure. Such transfer foils include a carrier layer on which an image-forming layer is applied over a separating layer. The separating layer is used to ease removal of the image-forming layer from the carrier layer. The image-forming layer can be, for example, a metallic layer, a gloss layer, a textured layer, a colored layer, or a layer containing one or more image patterns.

A foil supply roll 8 is allocated to the coating module 2 on the side of the sheet feeder. In this case, the foil supply roll 8 has a controllable rotary drive 7. The rotary drive 7 continuously controls the supply of the transfer foil 5 to the coating module 2.

Guide devices 14, such as deflection or tensioning rollers, pneumatically actuated guides, guide plates or the like, are provided in the vicinity of the foil inlet and outlet. Thus, the web of transfer foil 5 can be guided in a flat, smooth and undistorted manner and at the same tension relative to the press cylinder 3. The guide devices 14 can also include mechanisms for introducing the transfer foil 5. In this case, automatic take-in or insertion mechanisms can be used for the transfer foil 5. In this way, the feeding of the foil in the area of the various protection devices 15 surrounding the coating unit 2 is simplified. At the same time, the protective function of the protection devices 15 is fully maintained.

Advantageously, in the illustrated embodiment, the transfer foil 5 can be passed around the press cylinder 3 with the transfer foil 5 being fed and discharged from the press gap 6 from only one side of the coating module 2 (see dashed line representation in FIG. 1). In contrast to what is shown in FIG. 1, depending on the available space on the one side of the coating module 2, the foil sheet also can be guided so that the inlet strand and the outlet strand are positioned close to and parallel to each other. In another embodiment, the transfer foil 5 can also be fed to and discharged from the press gap with the transfer foil extending past the press cylinder 3 in an essentially tangential manner. Alternatively, the transfer foil can be wrapped around the press cylinder over a small circumferential angle. The transfer foil 5 can be fed from one side of the coating module 2 and discharged from the opposite side of the coating module 2.

A foil collection roller 9 is provided on the outlet or delivery side of the printing unit. The consumed foil material is rewound on the foil collection roller 9. In this case, a controllable roller drive 7 is provided to optimize production. The transfer foil 5 also could be moved on the outlet side by the roller drive 7 and held rigid on the inlet side by a brake. In this regard, it is possible to control the foil with a dancer roller 18 as discussed below.

To facilitate transfer of the image-forming layer from the transfer foil 5 to the printing sheet, the surface of the press cylinder 3 (i.e., the surface of the blanket cylinder or plate cylinder) can be equipped with a compressible, dampening element. To this end, the press cylinder 3 is equipped with a press pad or covering 10 or has a corresponding coating (see FIG. 2). The press covering 10 or press coating can be, for example, a plastic coating comparable to a rubber cloth or blanket. The surface of the press covering 10 or press coating is preferably very smooth. It can also be formed from non-adhesive materials or structures. In this case, a relatively hard structure in the form of relatively small spherical elements can be used. A press covering 10 can be held on the press roller 3 using tensioning or gripper devices arranged in a cylinder channel.

To improve the transfer characteristics in the transfer gap 6, the press covering 10 can have a specific elasticity. This elasticity can be achieved using a compressible intermediate layer. The compressibility is preferably similar to or less than that found in conventional rubber blankets or printing blankets which also can be used at this point. The compressibility also can be created using a conventional, compressible blanket. Combination coverings such as in the form of a hard blanket and a soft substrate can be used. A limited pressure surface can be provided directly on the press roller 3 or on the press covering 10. This limited pressure surface can be formed from the surface of the press covering 10 or the pressure surface can be attached to the press cylinder 3 in the form of a partial surface made of the same material as the press covering 10.

To improve the efficiency of the coating process, the foil advance of the transfer foil 5 from the foil supply roller 8 to the transfer gap 6 and to the foil collection roller 9 is controllable such that the transfer foil 5 is substantially stopped when there is to be no transfer of the image-forming layer. In this case, the transfer foil 5 can be controlled so that the foil advance is stopped when passing a gripper channel of the sheet-guiding impression cylinder 4. The grippers hold the printing sheet on the impression cylinder 4. The press cylinder 3 has a corresponding gripper channel 19 (see FIG. 2) for holding the press covering 10. In the area of the corresponding cylinder channels, the transfer foil 5 is not pressed between the press cylinder 3 (blanket cylinder) and the impression cylinder 4. In this area, the press cylinder 3 continues to slide past the transfer foil 5, while the transfer foil 5 is left not touching anything between press roller 3 and the impression cylinder 4. This state continues until the so-called printing start of the cylinder channel 19 ends where the transfer foil 5 is again clamped between the press roller 3 and the impression cylinder 4 together with a printing sheet. The transfer foil 5 can then be transported further. The cycling of the foil advance can begin or stop somewhat earlier than defined by the edges of the cylinder channel to accommodate any necessary acceleration or deceleration of the foil supply roller 8 or foil collection roller 9. As shown for example in FIG. 1, fast reacting cycling systems using so-called dancer rollers 18 may not require control of the roller drives 7 of the foil supply rollers 8 or foil collection rollers 9. In such a case, the required foil tension can be maintained by using the dancer rollers 18.

A further improvement in the utilization of the foil can be achieved by dividing the transfer foil 5 into one or more partial foil sheets of smaller width. In this way, with the appropriate control via the device or devices for timing the advance of each of the partial foil sheets, the utilization of the transfer foil 5 can be improved for coating regions of locally different length within a sheet. Each partial foil sheet is conveyed precisely in the areas where the imaging-forming layer is to be applied. In the areas that are not to be coated, each partial foil sheet can be stopped independently of the other partial foil sheets so as to prevent any unnecessary foil consumption.

To improve the coating process, dryers 16 can be provided in the vicinity of the adhesive application and in the vicinity of the foil application. In particular, the adhesive layer applied over the image area of the printing sheet can be dried by a first dryer 16 (intermediate dryer I) so that the usable or image-forming layer of the transfer foil 5 will adhere better. In addition, the adherence of the usable image-forming layer can be improved by using a second dryer 16 (intermediate dryer II) to further accelerate the drying of the adhesive.

The quality of the coating can be verified by an inspection or monitoring device 17 arranged after the application of the image-forming layer from the foil. In particular, the inspection device 17 is directed towards a sheet carrying area of the coating module 2 after the transfer gap 6. The inspection device 17 is optionally shielded from the dryer 16 or is directed towards a sheet carrying surface of another sheet carrying module downstream of the coating module 2. The coated printing sheet passing this location can be checked for completeness and quality of the coating. Any printing sheets identified as defective can be marked or sorted out as waste in a sorter.

According to one particular embodiment of the invention, a contoured or partial press surface 21 is provided as the surface of the press cylinder 3. In this case, instead of a press surface 20 that extends over the entire surface of the press cylinder, a partial press surface 21 whose outer boundaries are defined by the areas to be coated is used on the press cylinder 3. The partial press surface 21 can be designed as an isolated surface element, as a narrow, annular surface element surrounding the press cylinder 3, as a surface element following a mantle line, as a surface element covering a limited perimeter section, as a surface element extending across the width of the press cylinder 3 or as a combination of several such surface elements. A partial blanket, an imageable plastic printing plate, a high pressure form or a contact segment 22 can be used to carry the partial press surface. The contact segment 22 preferably is detachably fixed to a smooth substrate, possibly by adhesive or magnetic attraction. For example, a contact segment 22 with a magnetic surface on its underside can be placed directly atop the surface of the press cylinder 3. Alternatively, a magnetic foil can be stretched over the surface of the press roller 3. A contact segment 22 having a magnetic underside can then be set on the magnetic foil in order to position the partial press surface 21. The elasticity and smoothness of the surface and the inner structure of the contact segment 22 should correspond to the aforementioned requirements. In this case, a compressible blanket substrate 23 can be provided that carries a preferably smooth, relatively rigid functional layer 24.

Similar to the passage of the cylinder channel 19, a function of the partial press surface 21 is to ensure that the transfer foil 5 will only be clamped when the segmented press surface 21 passes through the transfer gap 6 in contact with the transfer foil 5. In other words, the press surface 21 will only act on the transfer foil 5 where the imaging-forming layers are actually to be transferred from the transfer foil 5 to the printing sheet. However, the foil transfer device has a corresponding controller for controlling the advance of the transfer foil 5 so as to ensure that at least the advance of the transfer foil will be stopped when the cylinder channel 19 is rotating past.

To improve the coating process, the invention provides that the advance of the transfer foil will be stopped in areas where no image-forming layer is removed. In such cases, the press cylinder 3 passes empty beneath the transfer foil 5. For example, this can occur when the cylinder channel 19 passes or, if using a partial press surface 21, when an area not covered the partial press surface passes. To stop the transfer foil 5, the transfer foil 5 must be detachable relative to the surface of the blanket cylinder or the press cylinder 3, respectively, or the press cylinder 3 can be equipped with an anti-adhesive surface. To this end, the area of the press roller can be provided with a compressed air discharge system. Using this system, a thin air layer can be formed under the transfer foil on the press cylinder 3 by bursting compressed air into the gap of the inlet or outlet of the transfer foil when the transfer foil is stopped. Thus, the press cylinder can continue to run while the transfer foil is stopped. In this case, the referenced dancer roller 18 can again be used to compensate for the foil run.

FIG. 2 provides a cross-sectional view of the press cylinder 3 while FIG. 3 provides a cross-sectional view of the press covering 10 on the surface of the press cylinder 3. The press covering on the press cylinder 3 can be, for example, a plastic coating, comparable to a rubber blanket or printing blanket. As shown schematically in FIG. 2, the press covering 10 is held to the tensioning devices in a cylinder channel 19. As noted above, the press covering 10 can be equipped with a specific elasticity to improve the transfer properties in the transfer gap 6. This compressibility is preferably similar to or less than that of conventional rubber blankets or printing blankets that can also be used at this point. This compressibility can be achieved in several different ways; however, one preferred arrangement involves using a press covering 10 comprising a printing blanket having a relatively thin, hard surface, consisting of a plastic coating as a functional layer 24. This functional layer 24 is equipped with a compressible substrate that consists of a compact, elastic material or a closed-cell or open-cell foam. A force-transferring layer, for example, a fabric layer, can be arranged under the compressible substrate. With such an arrangement, given the relatively high flexibility or compressibility of the surface, the press covering 10 has a relatively high strength. This has the particular advantage that the transfer foil will adapt particularly well to the specific printing sheet material used and/or to the specific adhesive used.

The surface of the press covering 10, in this case the plastic coating 24, should be very smooth. For this purpose, the plastic coating 14 has a low surface roughness with a peak-to-valley height in the range of 1 μm or less. The material of the press covering 10 preferably should also have a very low adhesion relative to the material used as the carrier layer in the transfer foil 5. Even though the surfaces of rubber blankets are also very smooth, they nonetheless will absorb ink and as a result the transfer foil will more likely adhere to conventional rubber blankets resulting in damage during transfer of the image-forming layer to the printing sheet.

Due to the plastic surface of the press covering 10, which has a low adhesion with respect to the transfer foil 5, a clean transfer of the image-forming layer onto the printing sheet is possible. This clean transfer is produced because the transfer foil 5 rests only against the printing sheet due to the press covering 10 and the transfer foil is guided past the printing sheet due to the adhesion at the adhesive sites. In such a case, the advance of the transfer foil should be coordinated so that displacements in the adhesion sites do not occur.

Because of the elasticity of the press covering 10, a very flexible transfer gap 6 is produced. Additionally, because the impression cylinder has, for example, a diameter twice that of the press cylinder 3, the transfer gap 6 can be enlarged in the direction of a relatively flat extension. In this case, to create an optimum transfer pressure in the transfer gap 6, a printing impression adjustment between the press cylinder 3 and the impression cylinder 4 can be selected that is somewhat greater than what is necessary for a conventional printing process. For example, adjustment values of 0.10 mm to 0.14 mm can be used in comparison to a standard value of 0.1 mm. On the other hand, when a press covering 10 with a smaller compressibility is used, a narrower and smaller transfer surface with greater surface pressure is attained. In this manner, the optimum transfer pressure in the transfer gap 6 will be achieved by a standard or even somewhat lower printing impression adjustment between the press cylinder 3 and the impression cylinder 4. As a result, a broad printing surface is achieved in the transfer gap 6. Moreover, reliable movement is achieved between the surface of the press cylinder 3 or the press covering 10 pressing against the transfer foil 5 and the back side of the transfer foil 5 resting upon the impression cylinder 4 or the printing sheet.

According to one alternative embodiment, if the foil transport takes place by coiling around the press cylinder 3, then an adhesion of the foil sheet 5 to the press cylinder 3 will occur. This can be the case when using an offset printing unit as described above. This adhesion can cause the transfer foil 5 to tear. Therefore, the surface of the press cylinder 3 can be equipped with a special surface. In this case, a low friction or low adhesion rubber blanket can be used. For example, instead of a standard rubber blanket, a so-called Pearl printing blanket can be used in order to minimize the friction between the surface of the press cylinder 3 and the transfer foil 5. The use of such Pearl printing blankets is known in other applications. Such Pearl printing blankets have very tiny glass spheres on their surface to reduce the contact surface with the neighboring element. Contact friction is avoided while the build-up of a static charge is prevented. With such a pearl printing blanket, the process will operate even without compressed air assistance for certain types of transfer foils even with the transfer foil coiling around the press cylinder 3. By altering the particular configuration of the surface of the pearl blanket (in which numerous small glass spheres correspond to a relatively smooth surface, and fewer large glass spheres correspond to a structured surface), finely structured image patterns can be transferred from the foil coating and desired structural effects can even be created on the surface of the foil coating.

Based on the foregoing it is possible to transfer different types of coatings in a transfer process from a transfer foil 5 to different substrate materials.

The detailed disclosure of the invention is not restricted to the possibilities presented herein, but rather can be interpreted more expansively by the ordinary person skilled in the art.

LIST OF REFERENCE SYMBOLS

1 Application unit
2 Coating module
3 Press cylinder
4 Impression cylinder
5 Transfer foil/foil sheet
6 Transfer gap
7 Roller drive
8 Foil supply roller
9 Foil collection roller
10 Press covering
11 Inking/dampening system
12 Plate cylinder
13 Blanket cylinder
14 Foil guide unit
15 Printing unit
16 UV-Dryer
17 Monitoring system
18 Dancer roller
19 Cylinder channel
20 Press surface
21 Partial press surface
22 Pressure segment
23 Substrate for blanket
24 Function layer

The invention claimed is:

1. A sheet fed rotary offset printing press for printing and processing individual printing sheets comprising:

a plurality of sheet fed rotary printing units each including a cylinder adapted for carrying a printing plate during a printing operation of the printing unit and an impression cylinder, a plurality of sheet transfer cylinders circumferentially around which individual sheets travel during movement between said printing units; said impression cylinders each receiving individual sheets from a respective transfer cylinder for transfer circumferentially around the impression cylinder;

one of said printing units functioning as an application unit for coating an image area on the individual printing sheets with an adhesive pattern;

a supply of transfer foil having a multi-layer structure including a carrier layer and an image forming layer, one of said printing units functioning as a coating unit for transferring an image forming layer of the transfer foil to the individual printing sheets, said one of said printing units that functions as a coating unit having a form or blanket cylinder that with the impression cylinder of the printing unit defines a sheet passage gap and which functions as a press cylinder, a transfer foil guiding device for guiding the transfer foil through said transfer gap with the carrier layer of the transfer foil in contacting relation to the press cylinder under pressure through the transfer gap with the coated side of the printing sheet in contact with the image forming layer of the transfer foil such that the image forming layer is transferred to the image area of the printing sheet having the adhesive pattern; and said press cylinder having a low-friction covering different from the surface covering of the impression cylinder, said low friction covering comprising a plastic outer surface comprising spherical elements positioned at substantially the same height on the surface and having a low surface roughness with a peak to valley height in the range of 1 μm or less and configured for limiting adhesion of the press cylinder to the carrier layer of the transfer foil during contacting engagement of the transfer foil so that the image forming layer is cleanly transferred and adhered to the adhesive pattern on the printing sheet in the transfer gap without displacement of the adhesive pattern on the printing sheet by contact of the press cylinder with the carrier layer of the transfer foil in the transfer gap.

2. The device according to claim 1 further including a controller for controlling the advance of the transfer foil such that the advance of the transfer foil is stopped when a gripper channel on the impression cylinder passes the transfer foil.

3. The device according to claim 1 wherein the low-friction covering is compressible.

4. The device according to claim 3 wherein the low-friction covering comprises a functional layer comprising a material having a low surface tension and a compressible substrate.

5. The device according to claim 4 wherein the low-friction covering is detachable and covers the entire cylindrical surface of the press cylinder.

6. The device according to claim 4 wherein the low-friction covering is detachable and covers only a portion of the cylindrical surface of the press cylinder.

7. The device according to claim 1 in which the transfer foil guiding device is operable for stopping guided movement of the transfer foil when no transfer of an image forming layer of the transfer foil is required whereby said low friction covering slides relative to the transfer foil without adversely altering a previously transferred image forming layer on the printing sheet.

8. The device according to claim 7 in which said low friction covering is disposed about said press cylinder with opposed ends clamped within a recess gripping chamber of the press cylinder.

9. The device according to claim 8 in which said transfer film guide device is operable for stopping the guiding movement of the transfer film when passing a gripper channel of the press cylinder.

10. A sheet fed rotary offset printing press for printing and processing individual printing sheets comprising:

a plurality of sheet fed rotary printing units each including a cylinder adapted for carrying a printing plate during a printing operation of the printing unit and an impression cylinder, a plurality of sheet transfer cylinders circumferentially around which individual sheets travel during movement between said printing units; said impression cylinders each receiving individual sheets from a respective transfer cylinder for transfer circumferentially around the impression cylinder;

one of said printing units functioning as an application unit for coating an image area on the individual printing sheets with an adhesive pattern;

a supply of transfer foil having a multi-layer structure including a carrier layer and an image forming layer, one of said printing units functioning as a coating unit for transferring an image forming layer of the transfer foil to the individual printing sheets, said one of said printing units that functions as a coating unit having a form or blanket cylinder that with the impression cylinder of the printing unit defines a sheet passage gap and which functions as a press cylinder, a transfer foil guiding device for guiding the transfer foil through said transfer gap with the carrier layer of the transfer foil in contacting relation to the press cylinder under pressure through the transfer gap with the coated side of the printing sheet in contact with the image forming layer of the transfer foil such that the image forming layer is transferred to the image area of the printing sheet having the adhesive pattern; and said press cylinder having a low-friction covering different from the surface covering of the impression cylinder, said low friction covering comprising a plurality of substantially spherical elements that are densely packed together and positioned at substantially the same height on the surface of the low friction covering configured for limiting adhesion of the press cylinder with the carrier layer of the transfer foil so that the image forming layer is cleanly transferred to the adhesive pattern on the printing sheet in the transfer gap without displacement of the adhesive pattern on the printing sheet by contact of the press cylinder with the carrier layer of the transfer foil in the transfer gap.

11. The device according to claim 10 in which said spherical elements are made of glass.

12. The device according to claim 10 in which said spherical elements are made of plastic.

* * * * *